US005507244A

United States Patent [19]

Lee

[11] Patent Number: 5,507,244

[45] Date of Patent: Apr. 16, 1996

[54] ACCESSORY MOUNTING STRUCTURE FOR SEAT FOR INFLATABLE VESSELS

[76] Inventor: Rodney S. Lee, 1708 Academy Dr., Melbourne, Fla. 32901

[21] Appl. No.: 436,154

[22] Filed: May 8, 1995

[51] Int. Cl.[6] ..... B63B 7/08

[52] U.S. Cl. ..... 114/345; 114/347; 114/363

[58] Field of Search ..... 114/345, 347, 114/354, 363; 441/40

[56] References Cited

U.S. PATENT DOCUMENTS

| | | | |
|---|---|---|---|
| 2,522,910 | 9/1950 | Wayne . | |
| 4,641,594 | 2/1987 | Birkett | 114/347 |
| 5,101,753 | 4/1992 | Hull et al. | 114/345 |
| 5,325,806 | 7/1994 | Lee | 114/345 |

*Primary Examiner*—Jesús D. Sotelo

*Attorney, Agent, or Firm*—Frank L. Kubler

[57] ABSTRACT

A vessel and seat accessory mounting apparatus includes an inflatable vessel having a flexible vessel floor and a front vessel end and a rear vessel end, a support structure for supporting a person in a seated position, where the support structure includes a top surface, and front and rear wall portions, an elongate member extending from the support structure having a surface substantially parallel to and abutting the vessel floor substantially along the entire length of the elongate member for more widely distributing the weight of the structure and the person over the vessel floor and extending to the front of and to the rear of the support structure, a seat accessory mounting cross-member including a first lateral end and a second lateral end and a mounting port for receiving and passing the elongate member through the mounting cross-member, and an accessory affixed to and extending from the accessory mounting cross-member.

12 Claims, 5 Drawing Sheets

ACCESSORY MOUNTING STRUCTURE FOR SEAT FOR INFLATABLE VESSELS

BACKGROUND OF THE INVENTION

1. Field of the Invention

The present invention relates generally to the field of accessories for inflatable water vessels having flexible vessel floors, such as inflatable canoes, rafts and kayaks. More specifically, the present invention relates to an accessory mounting structure for use with a seat for placing on the floor of such a vessel. The seat may be as described in a patent previously issued to applicant, and include a cushion on top of a seat box portion which may have a door to serve as a storage compartment. The seat box portion may have holes in the lower corners of its front and rear walls for receiving two parallel pipe sections which fit through these holes when preparing the seat for use. The parallel pipe sections distribute the weight of the seat and seat occupant over a wide area of the vessel floor, preventing the seat from bowing the floor downward and distorting the shape of the vessel. The parallel pipe sections are slid out of the holes when preparing the seat for storage. Alternatively the seat box portion rests on top of the parallel pipe sections.

The inventive seat accessory mounting structure includes an accessory mounting cross-member having a first lateral end and a second lateral end and a mounting port for receiving and passing the elongate member through the mounting cross-member, and an accessory connected to and extending from the accessory mounting cross-member. The accessory mounting cross-member may support a mast assembly, a rudder assembly, or a seat assembly of an alternative design to that of the previous patent to applicant.

2. Description of the Prior Art

There have thus far been few seats and accessories for use in inflatable boats, canoes and kayaks. None of these seats and accessories has included mast or rudder assemblies. None of these seats and accessories have been provided in an interconnected kit form for rapid assembly and disassembly while functioning to distribute kit and passenger weight broadly over a flexible vessel floor to minimize deformation of the vessel floor.

Hull, U.S. Pat. No. 5,101,753, issued on Apr. 7, 1992, teaches an attachable seat for an inflatable boat. Cross-members deliver the weight of the seat and compartment primarily onto the sides rather than the floor of the boat. A vertical brace member extends to the floor of the boat, but fails to distribute the load over the floor, and is intended to rest on a wooden deck. Thus, this structure is not well suited to soft bottom rafts and canoes. The fishing rod holders are merely half rings, and would not support and hold a rod securely. No provision is made for removably adding boat accessories such as sail and rudder assemblies.

Wayne, U.S. Pat. No. 2,522,910, issued on Sep. 19, 1950, teaches a collapsible boat having a series of ribs connected by an upper rim and lower belts and having a rigid, folding keel. The Wayne seats fit over the rigid keel and use the keel for support. A problem with Wayne is that the keel is a preexisting part of the boat not found on inflatable vessels, and the seats themselves provide no effective weight distribution. Once again, no provision is made for removably adding boat accessories such as sail and rudder assemblies.

Similar and less relevant art is contained in the file history of U.S. Pat. No. 5,325,806, issued on Jul. 5, 1994 to the present applicant. Various types of sail and rudder assemblies for inflatable vessels are known in the industry, but are not suitable for structurally combining with the inventive seat of the referenced prior patent to applicant.

It is thus an object of the present invention to provide a removable, transferrable accessory mounting structure for the seat for inflatable vessels disclosed in U.S. Pat. No. 5,325,806, referenced above, which distributes the weight of the seat and occupant widely over the floor of the vessel to minimize vessel deformation.

It is another object of the present invention to provide such an accessory mounting structure which can mount load-bearing accessories such as a vessel mast assembly and a vessel rudder assembly, and do so either separately or simultaneously.

It is finally an object of the present invention to provide such an accessory mounting structure which is simple in design and inexpensive to manufacture.

SUMMARY OF THE INVENTION

The present invention accomplishes the above-stated objectives, as well as others, as may be determined by a fair reading and interpretation of the entire specification.

A vessel and seat accessory mounting apparatus, including an inflatable vessel having a flexible vessel floor and a front vessel end and a rear vessel end, a support structure resting on the vessel floor for supporting a person in a seated position, where the support structure includes a top surface, and front and rear wall portions, an elongate member extending from the support structure having a surface substantially parallel to and abutting the vessel floor substantially along the entire length of the elongate member for more widely distributing the weight of the structure and the person over the vessel floor, an opening being provided in the front wall portion and a corresponding opening being provided in the rear wall portion and the member for distributing weight passing through the openings and extending to the front of and to the rear of the support structure, a seat accessory mounting cross-member including a first lateral end and a second lateral end and a mounting port for receiving and passing the elongate member through the mounting cross-member, and an accessory affixed to and extending from the accessory mounting cross-member.

The accessory may be a sail assembly including a mast member secured to and extending upwardly from the mounting cross-member, a boom member secured to and extending laterally from the mast member, and a sail secured to and extending between the mast member and the boom member. There is preferably provided a mast member port in the accessory mounting cross-member where the mast member removably and rotatably fits into the mast member port.

The accessory alternatively may be a rudder assembly including a rudder mounting member secured to and extending rearwardly from the accessory mounting cross-member through a port in the rear vessel end, a rudder pivotally connected to the rudder mounting member, and rudder directional control mechanism extending from the rudder. There is preferably provided a rudder mounting member port in the accessory mounting cross-member where the rudder mounting member removably fits into the rudder mounting member port.

The accessory still alternatively may be a seat assembly including a cushion member secured on top of and resting upon the elongate member and the mounting cross-member.

A vessel and seat accessory mounting apparatus is also provided, including an inflatable vessel having a flexible vessel floor and a front vessel end and a rear vessel end, a support structure for supporting a person in a seated position, where the support structure includes a top surface, and front and rear wall portions, an elongate member extending from the support structure having a surface substantially parallel to and abutting the vessel floor substantially along the entire length of the elongate member for more widely distributing the weight of the structure and the person over the vessel floor and extending to the front of and to the rear of the support structure, a seat accessory mounting cross-member including a first lateral end and a second lateral end and a mounting port for receiving and passing the elongate member through the mounting cross-member, and an accessory affixed to and extending from the accessory mounting cross-member.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
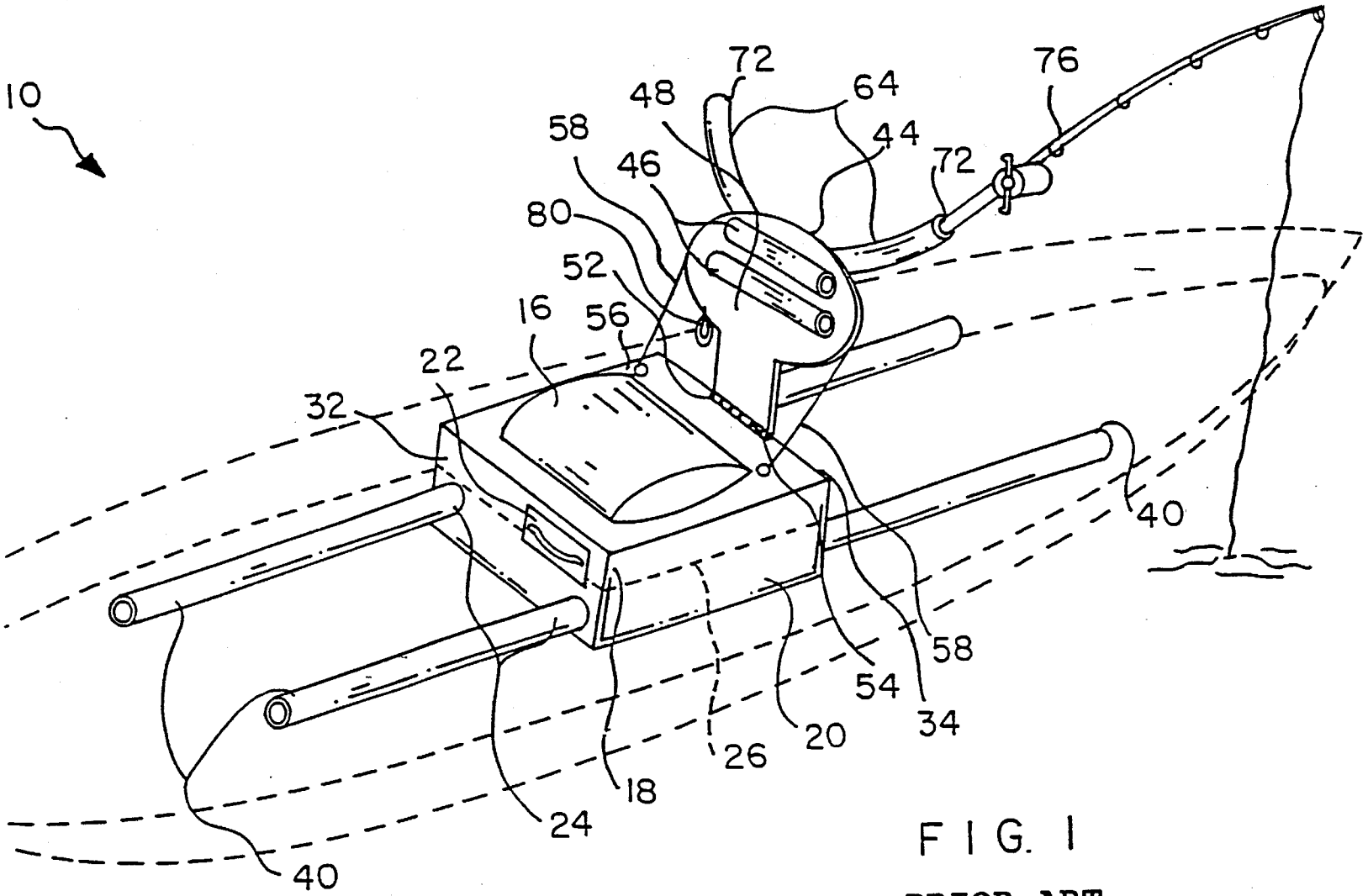
FIG. 1 PRIOR ART
FIG. 1 is a front perspective view of the patented boat seat positioned for use within an inflatable vessel.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

FIRST PREFERRED EMBODIMENT

Referring to the various FIGURES appended hereto, an accessory mounting structure 100 is disclosed for removably securing to a seat 10 for placing on the flexible floor 12 of an inflatable vessel 14, such as an inflatable canoe, raft or kayak. Seat 10 is described and claimed in U.S. Pat. No. 5,325,806, issued on Jul. 5, 1994 to the present applicant.

THE SEAT STRUCTURE

Figure 2:
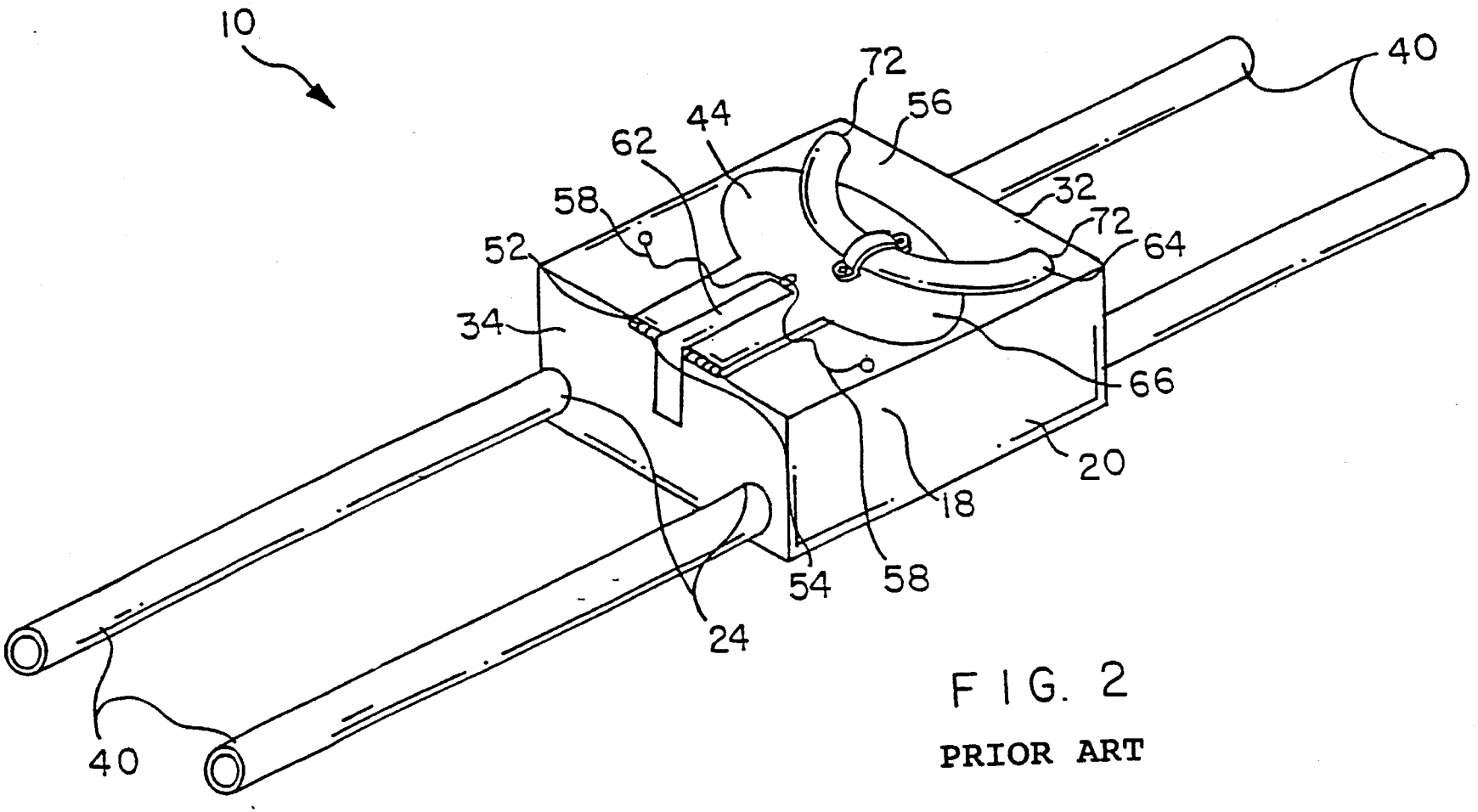
FIG. 2 PRIOR ART
FIG. 2 is a rear perspective view of the patented boat seat removed from the vessel, and with the hinged back rest lowered for transport and storage.
Figure 3:
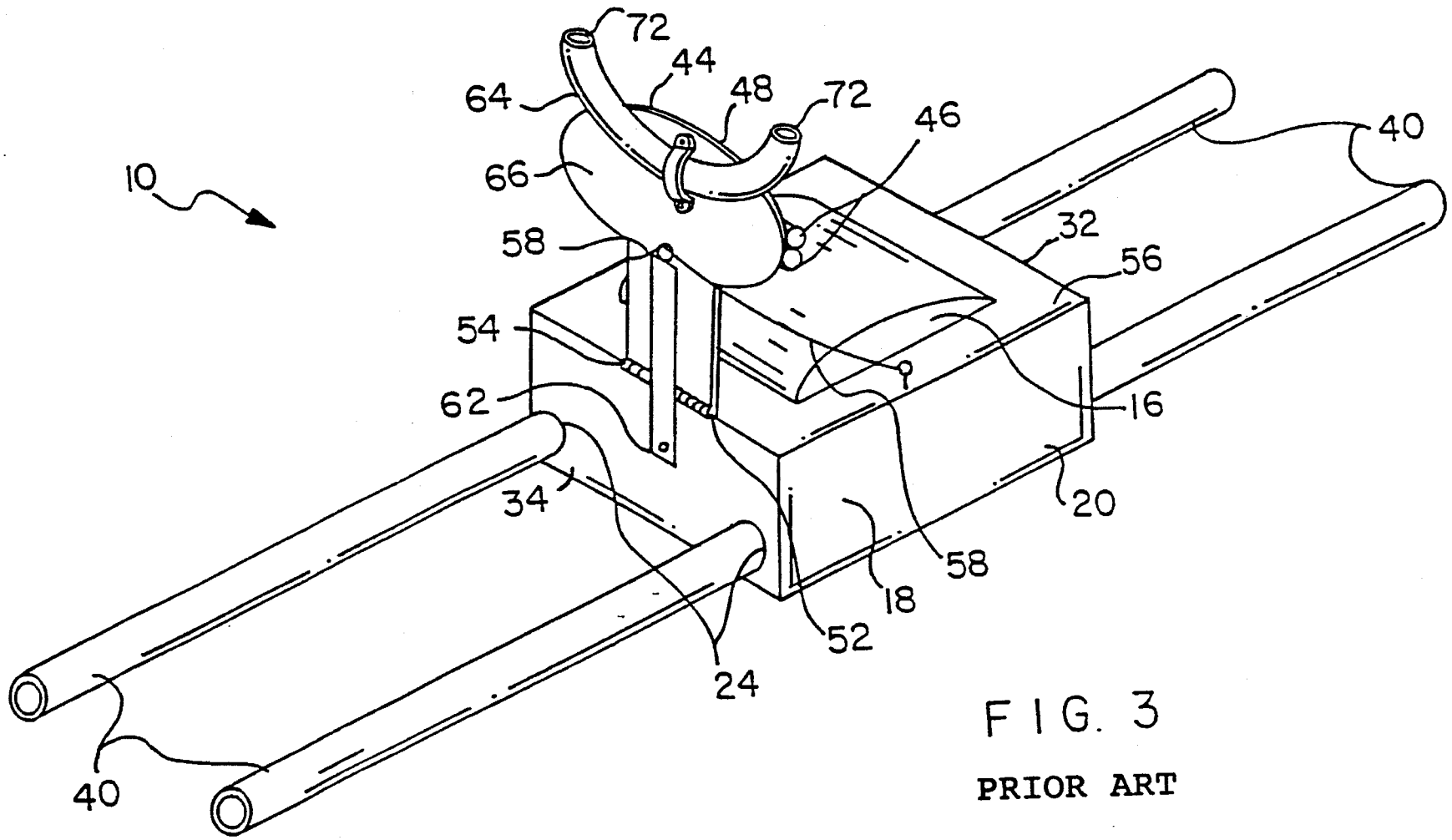
FIG. 3 PRIOR ART
FIG. 3 is a rear perspective view as in FIG. 2, except that the hinged back rest is raised for use.

Seat 10 preferably includes a cushion 16 on top of a box portion 20. See FIG. 1–3. Alternatively, box portion 20 may be a yielding lattice or mesh construction to itself act as a cushion. Box portion 20 has a door 22 and contains a storage compartment 18, which is optionally insulated for cold storage. A removable panel 26 preferably forms the bottom of storage compartment 18. Box portion 20 has ports 24 in the lower corners of its front wall 32 and its rear wall 34. Two parallel PVC pipe sections 40 fit through ports 24 and extend to the front and to the rear of box portion 20, to widely distribute the combined weight of box portion 20 and a seat occupant. Pipe sections 40 thereby prevent seat 10 from bowing floor 12 downward and distorting the shape of vessel 14. Pipe sections 40 are preferably cut to almost the full length of the floor 12 of a specific vessel 14. When seat 10 is to be transported or stored, pipe sections 40 are slid out of ports 24.

Seat 10 preferably includes a back rest panel 44 having soft tubular cushion members 46 attached to panel 44 front face 48. Panel lower edge 52 is joined to box portion 20 with hinges 54 to pivot against the top wall 56 of box portion 20 when seat 10 is to be stored. See FIG. 2. Adjustable cable members 58 limit the extent to which back rest panel 44 tilts back. An elastic member 62 is preferably removably attached at one end to panel 44 and at the other end to top wall 56, to bias panel 44 in an upright position against cable members 58. Arc-shaped tubular members 64 are preferably removably bolted to the rear face 66 of panel 44, so that the member ends 72 are directed upward for receiving the handle of at least one fishing rod 76. See FIG. 3. A utility hook or spring clasp 80 is preferably attached to panel 44. Member 62 is in this instance attached at one end to panel 44 and removably attached at the other end to top wall 56 with a hook.

Two seats 10 may be combined by sliding two box portions 20 over a single pair of pipe sections 40, one box portion 20 in front of the other box portion 20. For such an arrangement, box portions 20 are preferably strapped or hooked together. Alternatively box portion 20 rests on top of the parallel pipe sections 40.

SEAT ACCESSORIES AND ACCESSORY MOUNTING STRUCTURE

Figure 4:
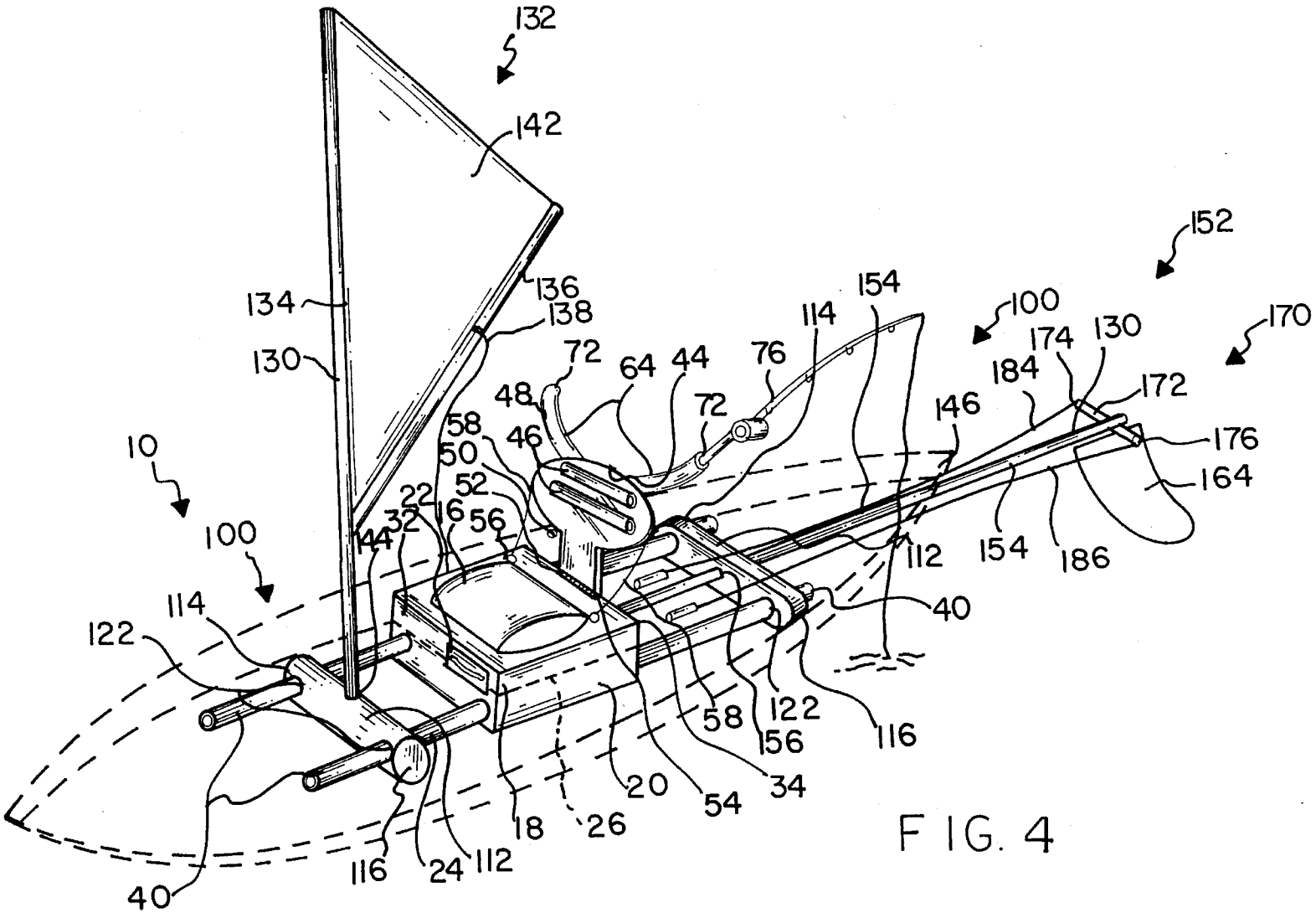
FIG. 4 is a front perspective view of two of the inventive accessory mounting structures fitted to the patented boat seat in an inflatable vessel, the vessel being shown in broken lines. The accessory mounting structures in turn are fitted with mast and rudder accessories.
Figure 5:
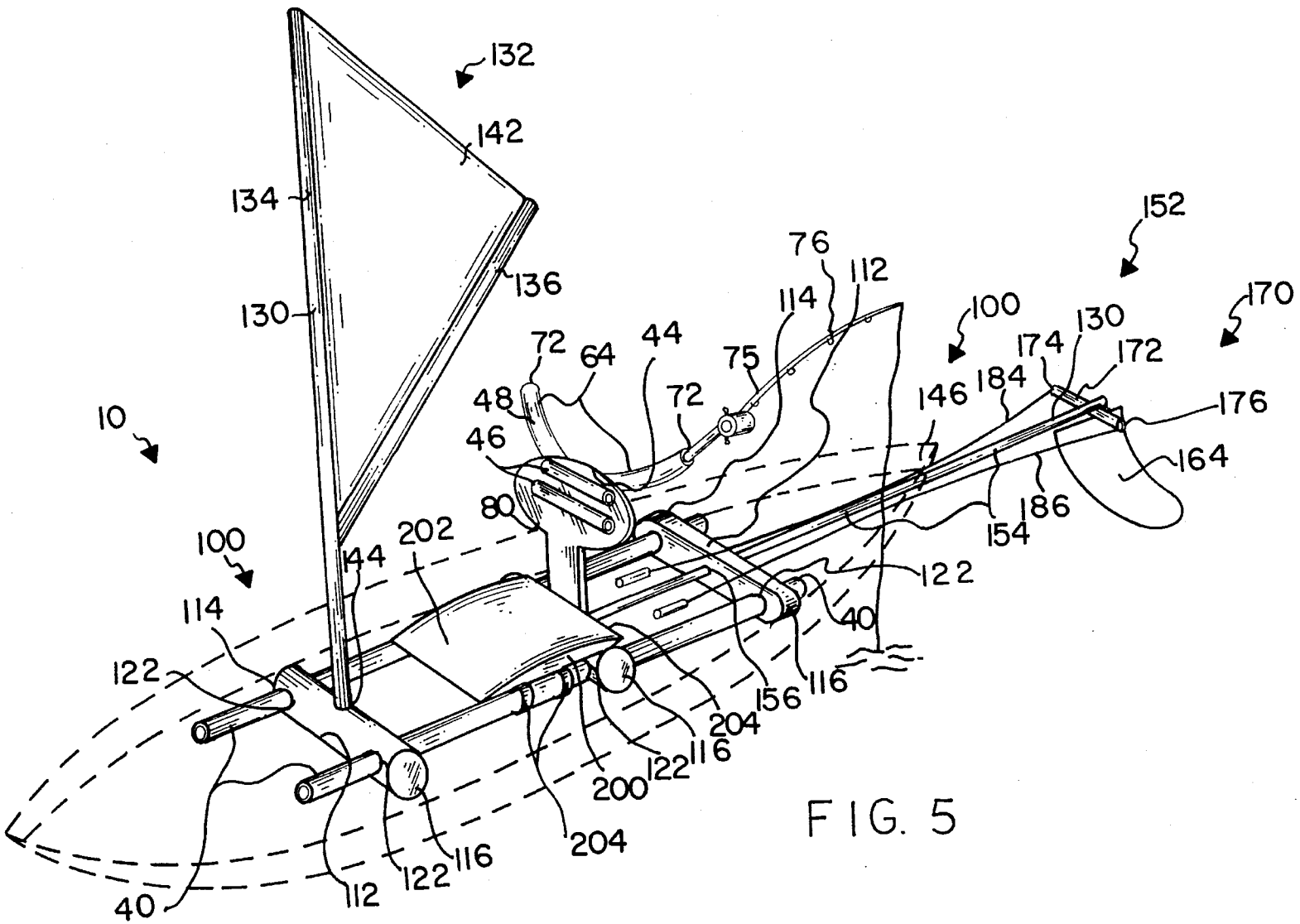
FIG. 5 is a view as in FIG. 4, except that the patented seat box is replaced with an accessory mounting structure and a cushion tied to the mounting structure and to the pipe sections.

The seat 10 accessory mounting structure 100 preferably includes an accessory mounting cross-member 112 in the form of a thick, elongate plate, or a cylinder, having a first lateral end 114 and a second lateral end 116. See FIGS. 4 and 5. First and second lateral ends 114 and 116 are preferably rounded to prevent injury. Two mounting ports 122 are provided in accessory mounting cross-member 112 for receiving and passing pipe sections 40 through accessory mounting cross-member 112. An accessory 130 is connected to and extends from accessory mounting cross-member 112.

The accessory 130 may be a mast assembly 132 including a mast member 134 secured to and extending upward from mounting member 112. A boom member 136 is secured to and extends laterally from mast member 134. A triangular sail 142 is secured to and extends between mast member 134 and boom member 136. A mast member port 144 is preferably provided in accessory mounting cross-member 112 for removably and rotatably receiving mast member 134. A boom cord 138 is preferably provided to retain boom member 136 and therefore to retain sail 142 against excessive movement away from the user during strong winds. Boom cord 138, which may be a bungee cord, is removably secured at one cord end to boom member 136 such as with hook means and is hand held or is removably secured to seat 10 at the other cord end.

The accessory 130 alternatively may be a rudder assembly 152 including a rudder mounting member 154 secured to and extending rearwardly from accessory mounting cross-member 112 and through a port 146 in the rear of vessel 14. Rudder mounting member 154 preferably extends removably through a rudder mounting member port 156 in accessory mounting cross-member 112 and through a center port (not shown) in box portion 34. A rudder 164 is pivotally connected to rudder mounting member 154. Rudder 164 is provided with a rudder directional control assembly 170 including a rudder control cross-member 172 having first and second control cross-member ends 174 and 176, respectively, Ends 174 and 176 extend laterally from rudder 164 and are pivotally connected to first and second control rods 184 and 186, respectively. Control rods 184 and 186 slidably extend into vessel 14 through port 146 and are gripped in operator hands or connect to an operator torso belt (not shown). Using the torso belt, the vessel 14 operator can steer vessel 14 merely by rotating his or her torso about the waist, thereby pushing one control while pulling the other, freeing the hands such as for paddling or for operating the sail 142. Rods 184 and 186 may be formed of narrow steel or plastic shafts, or of spring wire. Many other types of accessories 130 are contemplated for mounting onto accessory mounting cross-member 112.

Accessory mounting cross-member 112 may still alternatively be the base of a seat 200 either replacing or supplementing the seat 10 described in the previous patent issued to applicant. See FIG. 5. Seat 200 includes a cross-member 112 and a cushion 202 having cushion securing straps 204 extending from cushion 202 to removably tie around cross-member 112 and around pipe sections 40. Cushion 202 rests on pipe sections 40 and preferably also rests partly on cross-member 112.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A vessel and seat accessory mounting apparatus, comprising:

an inflatable vessel having a flexible vessel floor and a front vessel end and a rear vessel end, a support structure resting on said vessel floor for supporting a person in a seated position, wherein said support structure comprises a top surface, and front and rear wall portions, an elongate member extending from said support structure having a surface substantially parallel to and abutting said vessel floor substantially along the entire length of said elongate member for more widely distributing the weight of said structure and said person over said vessel floor, an opening being provided in said front wall portion and a corresponding opening being provided in said rear wall portion and said member for distributing weight passing through said openings and extending to the front of and to the rear of said support structure, a seat accessory mounting cross-member comprising a first lateral end and a second lateral end and a mounting port for receiving and passing said elongate member through said mounting cross-member, an accessory affixed to and extending from said accessory mounting cross-member.

2. The apparatus of claim 1, wherein said accessory is a sail assembly comprising:

a mast member secured to and extending upwardly from said mounting cross-member, a boom member secured to and extending laterally from said mast member, a sail secured to and extending between said mast member and said boom member.

3. The apparatus of claim 2, additionally comprising a mast member port in said accessory mounting cross-member wherein said mast member removably and rotatably fits into said mast member port.

4. The apparatus of claim 1, wherein said accessory is a rudder assembly comprising:

a rudder mounting member secured to and extending rearwardly from said accessory mounting cross-member through a port in said rear vessel end, a rudder pivotally connected to said rudder mounting member, rudder directional control means extending from said rudder.

5. The apparatus of claim 4, additionally comprising a rudder mounting member port in said accessory mounting cross-member wherein said rudder mounting member removably fits into said rudder mounting member port.

6. The apparatus of claim 1, wherein said accessory is a seat assembly comprising:

a cushion member secured on top of and resting upon said elongate member.

7. A vessel and seat accessory mounting apparatus, comprising:

an inflatable vessel having a flexible vessel floor and a front vessel end and a rear vessel end, a support structure for supporting a person in a seated position, wherein said support structure comprises a top surface, and front and rear wall portions, an elongate member extending from said support structure having a surface substantially parallel to and abutting said vessel floor substantially along the entire length of said elongate member for more widely distributing the weight of said structure and said person over said vessel floor and extending to the front of and to the rear of said support structure, a seat accessory mounting cross-member comprising a first lateral end and a second lateral end and a mounting port for receiving and passing said elongate member through said mounting cross-member, an accessory affixed to and extending from said accessory mounting cross-member.

8. The apparatus of claim 7, wherein said accessory is a sail assembly comprising:

a mast member secured to and extending upwardly from said mounting cross-member, a boom member secured to and extending laterally from said mast member, a sail secured to and extending between said mast member and said boom member.

9. The apparatus of claim 8, additionally comprising a mast member port in said accessory mounting cross-member wherein said mast member removably and rotatably fits into said mast member port.

10. The apparatus of claim 7, wherein said accessory is a rudder assembly comprising:

a rudder mounting member secured to and extending rearwardly from said accessory mounting cross-member through a port in said rear vessel end, a rudder pivotally connected to said rudder mounting member, rudder directional control means extending from said rudder.

11. The apparatus of claim 10, additionally comprising a rudder mounting member port in said accessory mounting cross-member wherein said rudder mounting member removably fits into said rudder mounting member port.

12. The apparatus of claim 7, wherein said accessory is a seat assembly comprising:

a cushion member secured on top of and resting upon said elongate member.

* * * * *